United States Patent [19]

Windhager

[11] 3,953,374

[45] Apr. 27, 1976

[54] ONE-PASS ELECTROCONDUCTIVE COATING COLOR FORMULATION

[75] Inventor: Robert H. Windhager, Pittsburgh, Pa.

[73] Assignee: Calgon Corporation, Pittsburgh, Pa.

[22] Filed: Feb. 19, 1974

[21] Appl. No.: 443,272

[52] U.S. Cl. ..... 252/518; 252/500

[51] Int. Cl.[2] ..... H01B 1/06; H01B 1/00

[58] Field of Search ..... 252/518, 500; 260/955

[56] References Cited

UNITED STATES PATENTS 3,620,828 11/1971 Werdouschegg et al. ..... 252/500

3,767,439 11/1973 Moyer et al. ..... 260/955

FOREIGN PATENTS OR APPLICATIONS 687,942 6/1964 Canada ..... 401/60

*Primary Examiner*—Leland A. Sebastian
*Assistant Examiner*—Josephine Lloyd
*Attorney, Agent, or Firm*—Harry E. Westlake, Jr.; Frank M. Mahon; Raymond M. Speer

[57] ABSTRACT

One-pass electroconductive coating color formulations are achieved by incorporating into electroconductive coating color formulations an effective quantity of a perfluoroalkyl phosphate salt.

12 Claims, No Drawings

ONE-PASS ELECTROCONDUCTIVE COATING COLOR FORMULATION

This invention relates to a process for improving the solvent holdout properties of coating color formulations employed in the manufacture of electroconductive papers. More particularly, this invention relates to a process for improving the solvent holdout properties of electroconductive polymer containing coating color formulations, so that such formulations may be applied to non-surface sized paper raw stock and the resultant coated paper will have solvent holdout and conductivity that are acceptable for conductive base stocks used in electroconductive paper grades, which comprises incorporating into such coating color formulations an effective quantity of a fluorocarbon of the type hereinafter defined; to electroconductive coating color formulations displaying improved solvent holdout properties which contain said fluorocarbon; and to the process of preparing electroconductive papers employing such improved coating color formulations.

In general, electroconductive base sheets for use in the manufacture of electrophotographic reproduction papers are prepared by applying to one or both surfaces of a suitable paper substrate (a publication grade paper of basis weight in the range of 30 to 45 pounds per 3,000 square feet) a resinous conductive layer to render the paper electroconductive. Commonly the conductive layer comprises an electroconductive polymer either alone or more usually, formulated with a binder (normally a water soluble, non-conductive film forming polymer such as a protein, starch, styrene-butadiene latices, a modified or converted starch, casein, polyvinylacetate, polyvinylalcohol, and the like) and with a pigment (such as calcium carbonate, kaolin clay, titanium dioxide, alumina or a combination of these materials). In the electrophotographic reproduction paper industry, such formulations including a conductive agent, a binder and a pigment are commonly referred to as coating color formulations or compositions.

The binders in conventional conductive coating color formulations serve to make the paper less porous more uniform, to improve the adherence of the conductive layer to the base paper and, importantly, to impart to the conductive layer the properties of a holdout or barrier coating to prevent solvents employed in the later applied photosensitive layers from penetrating into the conductivized paper. A separate non-conductive solvent holdout layer comprising one or a mixture of conventional binders is applied to the paper prior to the application of the conductive layer in order to assist in achieving a solvent holdout effect. Solvent holdout to both toluene and parafinic solvents is essential because the top side of a conductive base paper comes into contact with toluene during the subsequent application of the photosensitive coating which comprises dye-sensitized zinc oxide dispersed in a solution of toluene and a binder. The back side of the zinc oxide coated base stock (now referred to as finished Electrofax paper) comes into contact with kerosene during the copying process inside Electrox Copy Machines that use "wet" toners which are comprised of carbon particles suspended in a solution of kerosene and binders. The usual type of electroconductive polymer in combination with the usual type of coating color additives, such as the binders and pigments mentioned above, will not give acceptable solvent holdout when applied at commercially feasable coatweights of from 1 to 4 pounds of coating per 3,000 square feet per paper surface where attempts are made to prepare the conductive base sheet in an obviously desirable one-pass process without pretreatment of the paper raw stock with a separate solvent holdout layer.

The instant invention is based upon applicant's discovery that the solvent holdout properties of conventional coating color formulations, comprising the electroconductive polymers, binders and pigments commonly employed in such formulations, can be markedly enhanced by incorporating into such formulations an effective quantity of a fluorocarbon of the type hereinafter described. Applicant has found that the improved coating color formulations of this invention will give to the conductive base sheet surface resistivity, zinc oxide topcoatability, rebrokability of broke and enhanced solvent holdout properties that are commercially acceptable for the manufacture of electrophotographic reproduction papers according to current industry standards and practices, when applied to a non-surface sized raw stock (a raw stock that has no surface treatment of starch, alginate or other surface sizing material). The improved coating color formulations of this invention therefore, not only provide enhanced solvent holdout properties, but make possible the application of the electroconductive layer to the base sheet in a one-pass operation thus eliminating any necessity for the application of separate solvent holdout layers. The surface resistivity, zinc oxide topcoatability, rebrokability and solvent holdout properties obtained through the use of the improved coating color formulations of this invention have been confirmed employing standard laboratory techniques. It is contemplated, therefore, that suitable coatweights of the improved coating color formulations of this invention will be employed in the manufacture of electroconductive base sheets suitable for the preparation of electrophotographic and electrographic reproduction papers.

The nature of the electroconductive polymer component of the improved coating color formulations of this invention is not critical. Any of a variety of electroconductive polymers, both cationic and anionic, may be employed provided that the conductive polymer selected is capable of imparting adequate surface resistivity to the base raw stock (industry requirements for conductivity in base sheets are $10^{10}$ [ohms per square] decade at 15% relative humidity). As cationic electroconductive polymers, there may be employed any water soluble cationic polymer containing quaternary ammonium functional groups. Included in such cationic polymers are those wherein the quaternary ammonium functional group is carried as a pendant group to the principal polymer chain, such as, for example, polyvinyl benzyl trimethyl ammonium chloride, poly-[alpha-(methylene trimethyl ammonium chloride) ethylene oxide] and poly methacryloloxyethyl trimethyl ammonium chloride; those wherein the quaternary ammonium functional group is incorporated in a cyclic structure which comprises a portion of the polymer backbone, such as for example, poly-(dimethyldiallyl ammonium chloride); and those wherein the quaternary ammonium functional group forms a part of the polymer chain, such cationic polymers being commonly designated as, "ionenes."

Included in this group, for example, are ionene polymers prepared from halo alkyl dialkyl amine monomer units, such as 3-ionene(poly-(dimethyl propyl)-ammonium chloride), prepared by the polymerization of 3-chloropropyl dimethyl amine, and ionene polymers prepared from di-tertiaryamines and dihalides, such as 3,4-ionene which is prepared from 1,3-bis-dimethylamino propane and 1,4-dichlorobutene. Other ionene polymers, of course, which are prepared similarly, may be employed as the electroconductive component of the coating color formulations of this invention.

In addition to the cationic electroconductive polymers mentioned above, water soluble cationic phosphonium and sulfonium polymers also may be employed as the electroconductive component in the coating color formulations of this invention. Included among these are polymers, such as, for example, poly-(2-acryloxyethyldimethyl sulfonium chloride) and poly-(glycidyltributyl phosponium chloride) and the like.

Water soluble anionic polymers useful in the preparation of the coating color formulations of this invention typically are polymeric acids and alkali metal and alkaline earth metal salts. Included among such anionic polymers are, for example, poly(sulfostyrene), poly(allyl sulfonic) acid, sulfonated urea-formaldehyde resin sulfonated polymethylolacrylamide and the like.

It should be noted that the typical cationic and anionic polymers mentioned above may contain one or more other mer units. For example, copolymers such as the copolymer of dimethyl diallyl ammonium chloride and diacetone acrylamide or the copolymer of styrene and maleic acid also can be used as the electroconductive component of the coating color formulations of this invention. The ratio of mer units in such copolymers will be determined by the quantity of cationic or anionic necessary to impart the desired surface resistivity to the base sheet.

Although any of the electroconductive polymers noted above, or other electroconductive polymers capable of imparting the necessary degree of surface resistivity to the base sheet, may be employed as the electroconductive component in the improved coating color formulations of this invention, the preferred electroconductive polymers are the cationic polymers and copolymers and especially cationic quaternary ammonium polymers and copolymers. Of these the most preferred polymers are poly-(dimethyldiallylammonium chloride), copolymers of dimethyl diallyl ammonium chloride and diacetone acrylamide containing from 70 to 98% diallyl monomer, polyvinylbenzyl trimethyl ammonium chloride, poly-methacryloloxyethyl trimethyl ammonium chloride, polymethacryloloxytrimethylammonium methosulfate polyepichlorohydrin 80 to 100% quaternized with trimethylamine, copolymers of acrylamide and methacryloloxyethyl trimethyl ammonium chloride containing from 90 to 99.5% methacryloloxyethyl monomer and poly-(methacryloloxyethyl dimethyl hydroxyethyl ammonium chloride).

As noted above, the binders employed in the improved coating color formulations of this invention can be of great variety and do not constitute a critical aspect of the instant invention. Any of the water soluble, non-conductive, film-forming polymers conventionally employed for this purpose may be used in the coating color formulations of this invention. Suitable binders will include, for example, polyvinylalcohols, polyvinyl acetates, styrenebutadiene latices, polyethylene-polyvinyl acetate copolymers, unmodified starches, acetylated starches, hydroxyethyl starches, enzyme converted starches, oxidized starches, proteins, caseins, and the like or mixtures thereof. Similarly, any of the variety of pigments conventionally employed in coating color formulations may be employed in the improved color coating formulations of this invention including commercially available calcium carbonates, kaolin clays titanium dioxides aluminas or combinations of these materials.

The fluorocarbon component of the improved electroconductive coating color formulations of this invention is essential to achieving the enhanced solvent holdout properties displayed by the improved coating color formulations. Applicant has found that certain mono- and bis-(1H,1H,2H,2H-perfluoroalkyl)-phosphate esters, when incorporated into electroconductive coating color formulations in the quantities specified below, are effective in imparting to such formulations improved solvent holdout properties. In general, useful perfluoroalkyl phosphate esters will have the formula, $(C_mF_{2m+1}C_nH_{2n}O)_y\ PO(OM)_{3-y}$, wherein $m$ is an integer between 4 and 10, $n$ is an integer between 1 and 11, $y$ is 1 or 2 and M is a water solubilizing cation, such as, for example, an alkalimetal (Li, K, Na and the like), ammonium or substituted ammonium including methylamine, dimethylamine, diethylamine, monoethanolamine, diethanolamine, triethanolamine or morpholine and the like. Preferred salts generally are the diethanolamine salts. Desirably $C_m$ and $C_n$ taken together, constitute a straight chaim of at least 8 carbon atoms. Such perfluoroalkyl phosphate esters are well-known materials and are available commercially or readily prepared by methods fully described in the art. Particularly preferred is the perfluoroalkyl phosphate ester manufactured by E. I. du Pont de Nemours Company, Inc. Wilmington, Del., under the Trademark, ZONYL RP, which contains diethanolamine salts of mono- and bis-(1H,1H,2H,2H-perfluoroalkyl)phosphates where the alkyl group is even numbered in the range $C_8$–$C_{18}$ and the salts have a fluorine content of 52.4 to 54.4% as determined on a solids basis.

The weight percent (dry coating) of the several components in the improved coating color formulations of this invention may vary widely. In general, the electroconductive polymer component will constitute from 15 to 50% by weight of the formulation; the binder will constitute from 30 to 70% by weight of the formulation and the pigment will constitute from 10 to 60% by weight of the formulation. Such formulations are typical of the coating color formulations typically employed in the manufacture of electroconductive base sheets. In the improved coating color formulations of this invention, there is added to the conventional coating color formulation from 0.5 to 10% by weight of the formulation of a fluorocarbon, or mixture thereof, as defined above. Applicant has found that incorporation of the fluorocarbon into the coating color formulation markedly enhances the solvent holdout properties of the color coating formulation.

Although any of the binders, or mixtures thereof, as noted above may be employed in the coating color formulations of this invention, mixtures of polyvinyl acetate and polyvinyl alcohol are preferred. The polyvinyl acetate may constitute from 20 to 50% by weight of the formulation and the polyvinyl alcohol may constitute from 10 to 40% by weight of the formulation. When polyvinyl alcohol is employed in the binder, it is preferred to include in the formulation from 1 to 15% by weight of melamine as a cross-linking agent for the polyvinyl alcohol. Thus, preferred coating color formulations of this invention will contain:

| Component | Weight Percent of Component in Dry Coating |
|---|---|
| Conductive Polymer | 15 - 50 |
| Polyvinyl Acetate | 20 - 50 |
| Polyvinyl Alcohol | 10 - 40 |
| Fluorocarbon | 0.5 - 10 |
| Melamine | 1 - 15 |
| Pigment | 10 - 60 |

In order to illustrate the advantages derived from the use of the improved coating color formulations of this invention, coating color formulations containing fluorocarbon in accordance with the instant invention and coating color formulations containing no fluorocarbon were coated as aqueous emulsions on both sides of non-surface sized raw stock (31 lbs./3000 ft.$^2$ basis weight). The raw stock sheets were coated via draw downs with the appropriate wire-wound rod according to standard lab practices. The sheets were dried in a photographic print dryer for 15 seconds after coating.

A portion of the sheet, after conditioning at 50% relative humidity for at least 4 hours, was evaluated for solvent holdout by contacting the sheet with the appropriate solvent/dye solution [Bruning Dye (100 gm toluene, 35.8 gm polyvinyl acetate, 0.65 gm Sudan Irosol Dye, blue, General Aniline & Film Corporation) and Isopar G (Kerosene plus 2% flaming red dye)] for 10 seconds; immediately wiping the dye solvent from the sheet; visually inspecting the other side and estimating the penetration. Estimation of holdout was based on the reference chart used in the TAPPI (Technical Association of the Pulp and Paper Industry) New Provisional Method T-528. Another portion of the sheet was also tested after conditioning at 15% relative humidity, at least overnight, for surface resistivity using a 3.375 inch diameter disc from the sheet and a Keithley 610B Electrometer. Results of typical experiments are set forth below.

EXAMPLE 1

| Component | Weight Percent of Component in Dry Coating |
|---|---|
| Polymer 261LV [poly-(dimethyl diallyl ammonium chloride)] CALGON CORPORATION Pittsburgh, Pennsylvania | 20 |
| Fuller PD-069 (polyvinyl acetate) H. B. FULLER COMPANY St. Bernard, Ohio | 35 |
| Elvanol 51-05 (polyvinyl alcohol) E. I. du PONT de NEMOURS & COMPANY Wilmington, Delaware | 26 |
| Purecal O (Calcium carbonate) BASF WYANDOTTE COMPANY Wyandotte, Michigan | 15 |
| Virset 656-4 (melamine) VIRGINIA CHEMICALS COMPANY Portsmith, Virginia | 4 |
| | 100% |

A coatweight equivalent to 4 lbs./3000 ft.$^2$ was applied to each side of the raw stock. The coated sheet had unacceptable solvent holdout properties. Percent penetration by Bruning Dye was 60% and percent penetration by Isopar G was 90%. Current conductive base stock grades must have less than 10% penetration by Bruning Dye to prevent significant penetration of the toluene-based zinc oxide coating into the conductive substrate, and less than 50% penetration by Isopar G in order to obtain a suitably dry print from wet toner copy machines.

EXAMPLE 2

| Component | Weight Percent of Component in Dry Coating |
|---|---|
| Dow ECR-34 (polyvinylbenzyl trimethylammonium chloride) DOW CHEMICAL COMPANY Midland, Michigan | 20 |
| Dow 630 (styrene-butadiene latex) DOW CHEMICAL COMPANY Midland, Michigan | 31 |
| Vinol 523 (polyvinyl alcohol) AIR REDUCTION COMPANY, INC. New York, N. Y. | 30 |
| NuClay (Kaolin clay) FREEPORT KAOLIN COMPANY New York, N. Y. | 15 |
| Parez 613 (melamine) AMERICAN CYAMID COMPANY Wayne, New Jersey | 4 |
| | 100% |

A coatweight equivalent to 4 lbs./3000 ft.$^2$ was applied to each side of the raw stock. The coated sheet had unacceptable solvent holdout properties. Percent penetration by Bruning Dye was 40% and percent penetration by Isopar G was 80%.

EXAMPLE 3

| Component | Weight Percent of Component in Dry Coating |
|---|---|
| DOW ECR-34 | 22 |
| Fuller PD-069 | 31 |
| Elvanol 51-05 | 10 |
| Purecal O | 35 |
| Virset 656-4 | 2 |
| | 100% |

A coatweight equivalent to 4 lbs./3000 ft.$^2$ was applied to each side of the raw stock. The coated sheet had unacceptable solvent holdout properties. Percent penetration by Bruning Dye was 60%, and percent penetration by Isopar G was 90%.

EXAMPLE 4

| Component | Weight Percent of Component in Dry Coating |
|---|---|
| Polymer 261LV | 22 |
| Fuller PD-069 | 32 |
| Elvanol 51-05 | 12 |
| Purecal O | 30 |
| Zonyl RP | 2 |
| Virset 656-4 | 2 |
| | 100% |

A coatweight equivalent to 2.5 lbs./3000 ft.$^2$ was applied to each side of the raw stock. The coated sheet had acceptable solvent holdout properties. Percent penetration by Bruning Dye was less than 4% and percent penetration by Isopar G was 15%.

Surface resistivity at 15% R.H. was H.4×10¹⁰ ohms per square on one side and 3.8×10¹⁰ ohms per square on the other side. The usual industry requirements for surface resistivity in base stocks are 10¹⁰ decade at 15% R.H. or less.

A zinc oxide formulation [200 g zinc oxide, 60.5 g polyvinylacetate, 205.5 g toluene, 0.25 mls bromophenol blue (2.5% by weight in methanol), 0.75 mls uranine (2.5% by weight in methanol), 0.40 mls acid green 16 (2.5% by weight in methanol)], was coated on the wire side of the sheet and the resultant dry coating was uniform and free from cracks (i.e., "webbing").

Several conductive coated base sheets (with no zinc oxide coating) were rebroked in a Valley Beater and then hand-sheets were prepared on a Noble & Wood Hand-sheet Machine. The resultant hand-sheets had good formation and there was no evidence of fiber clumping or ropiness.

EXAMPLE 5

| Component | Weight Percent of Component in Dry Coating |
|---|---|
| Dow ECR-34 | 22 |
| Fuller PD-069 | 28 |
| Elvanol 51-05 | 10 |
| Purocal O | 35 |
| Zonyl RP | 3 |
| Virset 656-4 | 2 |
| | 100% |

A coatweight equivalent to 2.7 lbs./3000 ft.² was applied to each side of the raw stock. The coated sheet had acceptable solvent holdout properties. Percent penetration by Bruning Dye was less than 2% and percent penetration by Isopar G was 10%. Surface resistivities were 8.5×10¹⁰ ohms per square on one side and 8.4×10¹⁰ ohms per square on the other side at 15% R.H. A zinc oxide topcoating, applied on the wire side, was free of streaks and cracks and the conductive coated base sheet (no zinc oxide topcoating) rebroked well.

Example 6

| Component | Weight Percent of Component in Dry Coating |
|---|---|
| Nalco 61J16 (polyepichlorohydrin quaternized with trimethylamine) NALCO CHEMICAL COMPANY Chicago, Illinois | 22 |
| Fuller PD-069 | 28 |
| Vinol 523 | 10 |
| Purocal O | 35 |
| Zonyl RP | 3 |
| Virset 656-4 | 2 |
| | 100% |

A coatweight equivalent to 2.9 lbs./3000 ft.² was applied to each side of the raw stock. The coated sheet had acceptable solvent holdout and surface resistivity properties. Percent penetration by Bruning Dye was less than 2%. Surface resistivities were 5.6×10¹⁰ ohms per square on one side and 3.3×10¹⁰ ohms per square on the other side at 15% R.H. Rebrokability of conductive coated sheets (no zinc oxide coating) was acceptable and zinc oxide coated well on the base stock.

Although the instant invention has been described above in terms of the use of certain mono- and bis-(1H,1H,2H,2H-perfluoroalkyl)phosphates as the essential component of the improved coating color formulations of this invention, many obvious modifications will suggest themselves to one skilled in the art from a consideration of the foregoing specification. It will be obvious, for example, that fluorocarbons other than the perfluoroalkyl phosphates disclosed above could be substituted in the practice of the instant invention. Included among such fluorocarbons, for example, are long chain polyfluoro aliphatic fluorocarbons substituted with polar functions such as carboxyl, carbamate, carboxamide, sulfonamide, sulfonate, amino or quaternary amine groups. Applicant considers all such obvious modifications to be the full equivalent of the perfluoroalkyl phosphates specifically disclosed herein and to fall within the scope of the instant invention.

The subject matter which applicant regards as his invention is particularly pointed out and distinctly claimed as follows:

1. A method for enhancing the solvent holdout properties of electroconductive coating color formulations containing from 15 to 50% by weight of a water soluble electroconductive polymer, from 30 to 70% by weight of a water soluble, non-conductive film-forming polymeric binder, and from 10 to 60% by weight of a pigment which comprises adding to such formulations from 0.5 to 10% by weight of mono- and bis-(1H,1H,2H,2H-perfluoroalkyl)-phosphate esters of the formula:

$$(C_mF_{2m+1}C_nH_{2n}O)_yPO(OM)_{3-y}$$

wherein $m$ is an integer between 4 and 10, $n$ is an integer between 1 and 11, $y$ is 1 or 2 and M is a water solubilizing cation selected from the group consisting of an alkali metal, ammonium or substituted ammonium.

2. The method of claim 1 in which the water solubilizing cation is diethanolamine and $C_m$ and $C_n$, taken together, constitute a straight chain of at least eight carbon atoms.

3. The method of claim 2 in which the fluorocarbon is a member selected from the group consisting of diethanolamine salts of mono- and bis-(1H,1H,2H,2H-perfluoroalkyl)-phosphates wherein the alkyl group is even numbered in the range $C_8$–$C_{18}$ and the salts have a fluorine content of 52.4 to 54.4% as determined on a solids basis.

4. The method of claim 3 in which the water soluble electroconductive polymer is a cationic quaternary ammonium polymer.

5. The method of claim 4 in which the cationic quaternary ammonium polymer is a member selected from the group consisting of poly-(dimethyl diallyl ammonium chloride), a copolymer of dimethyl diallyl ammonium chloride and diacetone acrylamide containing from 70% to 98% of diallyl monomer units, polyvinylbenzyl trimethyl ammonium chloride, polymethacryloloxyethyl trimethyl ammonium chloride, polymethacryloloxyethyl trimethyl ammonium methosulfate, polyepichlorohydrin 80 to 100% quaternized with trimethylamine, copolymers of acrylamide and methacryloloxyethyl trimethyl ammonium chloride containing from 90 to 99.5% methacryloloxyethyl monomer, and poly-(methacryloloxyethyl dimethyl hydroxyethyl ammonium chloride.

6. The method of claim 5 in which the binder is a mixture of polyvinyl acetate and polyvinyl alcohol in which the polyvinyl acetate constitutes from 20 to 50% by weight of the formulation and the polyvinyl alcohol constitutes from 10 to 40% by weight of the formulation and wherein there is added to the formulation from 1 to 15% by weight of melamine.

7. In an electroconductive coating color formulation containing from 15 to 50% by weight of a water soluble electroconductive polymer, from 30 to 70% by weight of a water soluble, non-conductive film-forming polymer binder, and from 10 to 60% by weight of a pigment, the improvement which comprises from 0.5 to 10% by weight of the coating color formulation of mono- and bis-(1H,1H,2H,2H-perfluoroalkyl)-phosphate esters of the formula:

$$(C_mF_{2m+1}C_nH_{2n}O)_yPO(OM)_{3-y}$$

wherein $m$ is an integer between 4 and 10, $n$ is an integer between 1 and 11, $y$ is 1 or 2 and M is a water solubilizing cation selected from the group consisting of an alkali metal, ammonium or substituted ammonium.

8. The method of claim 7 in which the water solubilizing cation is diethanolamine and $C_m$ and $C_n$, taken together, constitute a straight chain of at least eight carbon atoms.

9. The coating color formulation of claim 8 in which the fluorocarbon is a member selected from the group consisting of diethanolamine salts of mono- and bis-(1H,1H,2H,2H-perfluoroalkyl)phosphates wherein the alkyl group is even numbered in the range $C_8$–$C_{18}$ and the salts have a fluorine content of 52.4 to 54.4% as determined on a solids basis.

10. The coating color formulation of claim 9 in which the electroconductive polymer is a cationic-quaternary ammonium polymer.

11. The coating color formulation of claim 10 in which the cationic-quaternary ammonium polymer is a member selected from the group consisting of poly-(dimethyl diallyl ammonium chloride), a copolymer of dimethyl diallyl ammonium chloride and diacetone acrylamide containing from 70 to 98% of diallyl monomer units, polyvinylbenzyl trimethylammonium chloride, polymethacryloloxyethyl trimethyl ammonium chloride, polymethacryloloxyethyl trimethyl ammonium methosulfate, polyepichlorohydrin 80 to 100% quaternized with trimethylamine, copolymers of acrylamide and methacryloloxyethyl trimethyl ammonium chloride containing from 90 to 99.5% methacryloloxyethyl monomer, and poly-(methacryloloxyethyl dimethyl hydroxyethyl ammonium chloride).

12. The coating color formulation of claim 11 in which the binder is a mixture of polyvinyl acetate and polyvinyl alcohol in which the polyvinyl acetate constitutes from 20 to 50% by weight of the formulation and the polyvinyl alcohol constitutes from 10 to 40% by weight of the formulation and wherein there is added to the formulation from 1 to 15% by weight of melamine.

* * * * *